US009156072B2

(12) United States Patent
Cha et al.

(10) Patent No.: US 9,156,072 B2
(45) Date of Patent: Oct. 13, 2015

(54) ULTRASONIC EXTRUSION APPARATUS FOR METAL MATERIAL

(71) Applicant: KOREA INSTITUTE OF INDUSTRIAL TECHNOLOGY, Chungcheongnam-do (KR)

(72) Inventors: Hyun Rok Cha, Gwangju (KR); Dae Yeong Im, Jeollanam-do (KR)

(73) Assignee: Korea Institute of Industrial Technology (KR)

( * ) Notice: Subject to any disclaimer, the term of this patent is extended or adjusted under 35 U.S.C. 154(b) by 308 days.

(21) Appl. No.: 13/731,468

(22) Filed: Dec. 31, 2012

(65) Prior Publication Data

US 2014/0182347 A1 Jul. 3, 2014

(51) Int. Cl.
*B21C 23/00* (2006.01)

(52) U.S. Cl.
CPC ..... *B21C 23/004* (2013.01)

(58) Field of Classification Search
CPC ..... B21C 25/02; B21C 25/20; B21C 25/21; B21C 23/004
USPC ..... 72/253.1, 270, 271, 272, 710, 467, 264, 72/269
See application file for complete search history.

(56) References Cited

U.S. PATENT DOCUMENTS 3,203,215 A * 8/1965 Jones ..... 72/253.1
2005/0061651 A1* 3/2005 Chou ..... 200/520

FOREIGN PATENT DOCUMENTS

JP 11-138210 A 5/1999
KR 10-2008-0090810 A 10/2008

* cited by examiner

*Primary Examiner* — Peter DungBa Vo
*Assistant Examiner* — John S Lowe
(74) *Attorney, Agent, or Firm* — Levenfeld Pearlstein, LLC

(57) ABSTRACT

Disclosed herein is an ultrasonic extrusion apparatus which causes resonance of an extrusion die using ultrasonic vibrations, thus reducing friction between the extrusion die and an extrusion material. The ultrasonic extrusion apparatus has an increased number of ultrasonic vibrators provided around the extrusion die in the circumferential direction to increase the vibration output, whereby when extruding a metal material such as a magnesium material, friction between the metal material and the extrusion die can be reduced, thus improving the performance of the extrusion process (preventing a reduction in an extrusion rate, generation of heat, cracking of a product, errors in measurements, etc.).

5 Claims, 13 Drawing Sheets

ULTRASONIC EXTRUSION APPARATUS FOR METAL MATERIAL

BACKGROUND OF THE INVENTION

1. Field of the Invention

The present invention relates generally to ultrasonic extrusion apparatuses which cause resonance of extrusion dies using ultrasonic vibrations, thus reducing friction between the extrusion dies and extrusion materials and, more particularly, to an ultrasonic extrusion apparatus which has an increased number of ultrasonic vibrators provided around the extrusion die in a circumferential direction to increase the vibration output, whereby when extruding a metal material such as a magnesium material, friction between the metal material and the extrusion die can be reduced, thus improving the performance of the extrusion process (preventing a reduction in an extrusion rate, generation of heat, cracking of a product, errors in measurements, etc.).

2. Description of the Related Art

Generally, it is difficult to shape a metal material such as a magnesium material because of friction between tools and the material to be shaped.

For this reason, an extrusion method is mainly used to shape a metal material. Typically, as shown in FIG. 1A, the method of extruding a metal material includes passing a molten metal material 20 through an extrusion die 10, thus forming a metal product 22 having a desired shape.

This metal extrusion method is a method which is used to manufacture high-density and high-quality products at a high production rate. However, the conventional extrusion method has many problems which occur because of friction between the extrusion die 10 and the metal material 20 to be extruded.

To overcome these problems, as shown in FIG. 1B, a technique was proposed, in which an ultrasonic vibrator 10 applies ultrasonic resonance to the extrusion die 10 which shapes a metal material, thus minimizing friction between the extrusion die 10 and the metal material, thereby enhancing the effectiveness of the extrusion process.

FIG. 2 shoos a conventional ultrasonic resonance system 50 in which ultrasonic resonance is applied to the extrusion die 10 to reduce friction between an extrusion material 20 and an extrusion die 10, thus improving the process of forming a rod-shaped product.

In the conventional ultrasonic resonance system 50, two ultrasonic vibrators 40 are respectively provided on upper and lower portions of too extrusion die 10. The ultrasonic vibrators 40 generate ultrasonic waves. For this, an ultrasonic wave generator 60, first and second amplifiers 62 and 64, a pressure controller 66, an oscilloscope 68, a heater controller 70, etc. are connected to the ultrasonic vibrators 40.

In detail, the ultrasonic wave generator 60 outputs a voltage at 10V in a from of sine wave to operate the ultrasonic vibrators 40. Each of the first and second amplifiers 62 and 64 amplifies the voltage output from the ultrasonic wave generator 60 to from 10 to 100 times and supplies it to the corresponding ultrasonic vibrator 40.

Furthermore, the pressure controller 66 controls a piston 72 of a double-acting extruder with a pressure ranging from 0 ton to 500 tons. The oscilloscope 68 measures the voltage and current applied to the ultrasonic vibrators 40. The heater controller 70 maintains the temperature of extrusion material (magnesium) 20, which is approximately 200° C., so that the extrusion material 20 is prevented from being cooled.

As shown in FIG. 3, compared to the metal extrusion method using no ultrasonic vibrator, the conventional ultrasonic resonance system 50 having the above-mentioned construction can markedly reduce friction between the extrusion die 10 and the extrusion material 20, thus making it possible to manufacture higher-density and higher-quality metal products at a high production rate.

However, as shown in FIG. 4, in the case of the extrusion die 10 provided in the conventional ultrasonic resonance system 50, opposite surfaces of a die body 12 which is fixed between an extruder heater 82 and a die holder 34 are planar. An extrusion hole which has a cylindrical or polygonal shape having a constant cross-sectional area is transversely formed through a central portion of the extrusion die 10

Furthermore, a plurality of mounting holes 16 are formed in a circumferential outer surface of the die body 12 at diametrically opposite positions. The two ultrasonic vibrators 40 are fastened to two portions of the die body 12 through the corresponding amounting holes 16 end apply vibrations to the extrusion die 10.

However, in the conventional extrusion die 10, a front surface of the die body 12 is a planar surface and is brought into direct contact with the extrusion material 20. Thus, extrusion pressure, ranging from about 90 tons to about 150 tons, for extruding the extrusion material 20 is directly transmitted to the front surface of the die body 12. A rear surface of the die body 12 is also planar, is brought into close contact with a front surface of the die holder 84, and is reliably integrally fixed to the die holder 84.

Therefore, in the case of the conventional extrusion die 10, even if vibrations are applied from the ultrasonic vibrators 40 to the extrusion die 10, they are disturbed by high extrusion pressure of the extrusion material 20 and dispersed to the outside through the die holder 84. Thus, the vibrations cannot be effectively transmitted to the extrusion die 10, so it is difficult to obtain a satisfactory vibration effect. Moreover, a phenomenon in which a vibration mode deviates from normal conditions is also caused.

In addition, because only the two ultrasonic vibrators 40 that are disposed on the upper and lower portions of the die body 12 apply vibrations to the die body 12 in the directions facing each other, vibrations cannot be evenly applied to the overall shaping space in the extrusion die 10, but vibrations are partially applied to only the upper and lower portions of the die body 12, thus greatly reducing substantial ultrasonic vibration effect.

SUMMARY OF THE INVENTION

Accordingly, the present invention has been made keeping in mind the above problems occurring in the prior art, and an object of the present invention is to provide an ultrasonic extrusion apparatus for metal material which is configured such that vibrations generated from ultrasonic vibrators mounted to an extrusion die are effectively transmitted to the extrusion die, whereby when an extrusion process is conducted, friction between the extrusion die and the metal material is minimized so that high-density and high-quality metal products can be manufactured at a high production rate.

Another object of the present invention is to provide an ultrasonic extrusion apparatus for metal material in which pressure required to shape the metal material that is applied to a front surface of the extrusion die can be minimized, and outward dispersion of vibrations transmitted from the ultrasonic vibrator to the extrusion die can be minimized, so that vibrations generated from the ultrasonic vibrators can be more effectively transmitted to the extrusion die while the extrusion process is being carried out.

In order to accomplish the above object, the present invention provides an ultrasonic extrusion apparatus for extruding a metal material in such a way that an extrusion die is resonated by ultrasonic vibrations, the ultrasonic extrusion apparatus including: a die body disposed between an extrusion piston and a die holder; front and rear conical surfaces respectively formed on front and rear surfaces of the die body, each of the front and rear conical surfaces being concave; an extrusion hole passing through central portions of the front and rear conical surfaces between the front and rear conical surfaces, the extrusion hole being defined by a first inner diameter part through which the metal material is actually extruded and a second inner diameter part having a diameter larger than the first inner diameter part so that the metal material that has passed through the first inner diameter part is prevented from coming into contact with the second inner diameter part; and a plurality of ultrasonic vibrators mounted to a circumferential outer surface of the die body, the ultrasonic vibrators applying the ultrasonic vibrations to the die body, wherein the ultrasonic vibrators are arranged around the circumferential outer surface of the extrusion hole of the die body to be symmetrical based on the extrusion hole so that the ultrasonic vibrations are evenly applied to the die body.

Furthermore, a plurality of chamfering surfaces may be formed on the circumferential outer surface of the extrusion hole of the die body at positions spaced apart from each other at regular intervals with respect to a circumferential direction, a mounting hole may be formed in a central portion of each of the chamfering surfaces, and the ultrasonic vibrators may be mounted to the respective chamfering surfaces through the corresponding mounting holes.

The chamfering surfaces may comprise six chamfering surfaces formed on the circumferential outer surface of the die body, and the ultrasonic vibratos may comprise six ultrasonic vibrators mounted to the respective six chamfering surfaces through the corresponding six mounting holes.

The ultrasonic extrusion apparatus may further include a cylindrical jig disposed on the front conical surface of the die body, wherein the extrusion piston may be disposed in the jig so that a shaping pressure is formed in the jig, thus reducing an extruding pressure applied to the front conical surface of the die body.

The ultrasonic extrusion apparatus may further include a vibration isolation unit disposed between the rear conical surface of the die body and the die holder to reduce a vibration transmitted from the die body to the die holder, the vibration isolation unit including: front and rear circular plates disposed facing each other; and a connector disposed inside the front and rear circular plates, wherein front surfaces of the front circular plate and connector may be closely fixed to a rear surface of the die body, and rear surfaces of the rear circular plate and connector may be closely fixed to a front surface of the die holder, and a through hole may be formed in a central portion of the connector so that the extrusion hole communicates with an internal space of the die holder through the through hole.

The through hole of the connector may have a diameter larger than the diameter of the extrusion hole of the die body.

In an ultrasonic extrusion apparatus according to the present invention, front and rear conical surfaces that are concave are respectively formed on front and rear surfaces of a die body which is disposed between an extrusion piston and a die holder. In addition, a cylindrical jig is provided on the front conical surface. Thereby, extrusion pressure which is transmitted to the front surface of the die body can foe markedly reduced.

Furthermore, a vibration isolation unit is installed between the rear conical our face of the die body and a die holder so that vibrations which are transmitted from the die body to the die holder can be markedly reduced.

Moreover, a plurality of ultrasonic vibrators which apply vibrations to the extrusion die are arranged around the extrusion die in the circumferential direction so that vibrations can be evenly applied to the entirety of extrusion die. Therefore, vibrations which are generated from the ultrasonic vibrators mounted to the extrusion die can be effectively transmitted to the extrusion die so that friction between the metal material and the extrusion die can be minimized during the extrusion process.

Ultimately, compared to the conventional ultrasonic extrusion apparatus, the ultrasonic extrusion apparatus of the present invention can produce high-density and high-quality metal products at a high production rate.

BRIEF DESCRIPTION OP THE DRAWINGS

The above and other objects, features and advantages of the present invention will be more clearly understood from the following detailed description taken in conjunction with the accompanying drawings, in which.

Figure 12A:
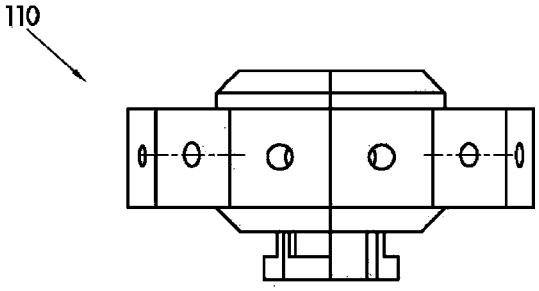
Figure 12C:
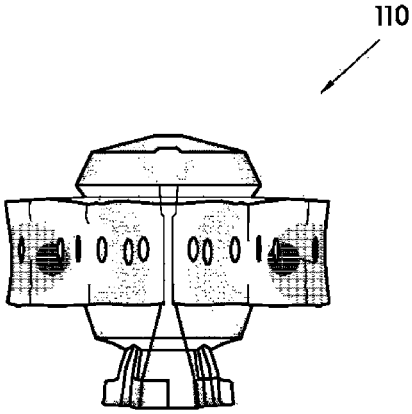
Figure 12B:
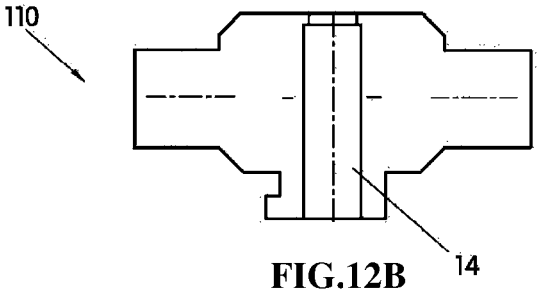
Figure 13A:
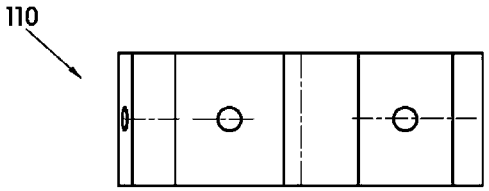
Figure 13B:
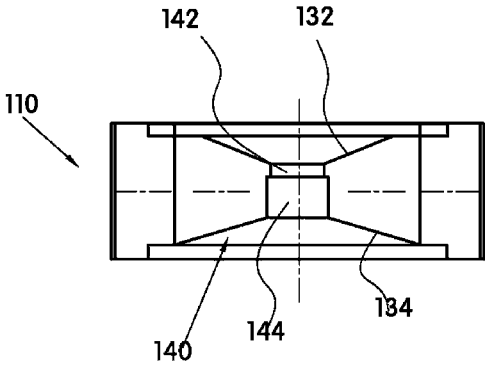
Figure 13C:
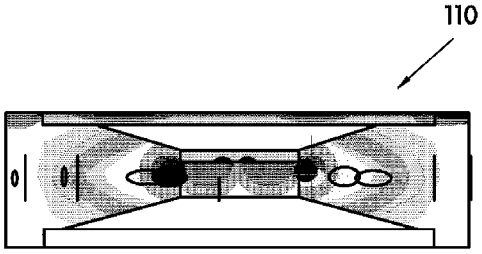

FIGS. 12A, and 12B and 12C are views illustrating the result of simulation of a series of vibration transmission in a conventional extrusion die; and FIGS. 13A, and 13B and 13C are views illustrating the result of simulation of a series of vibration transmission in the extrusion die of the ultrasonic extrusion apparatus according to the present invention.

DESCRIPTION OF THE PREFERRED EMBODIMENTS

Hereinafter, a preferred embodiment of the present invention will be described in detail with reference to the attached drawings.

Reference now should be made to the drawings, in which the same reference numerals are used throughout the different drawings to designate the same or similar components.

Figure 5:
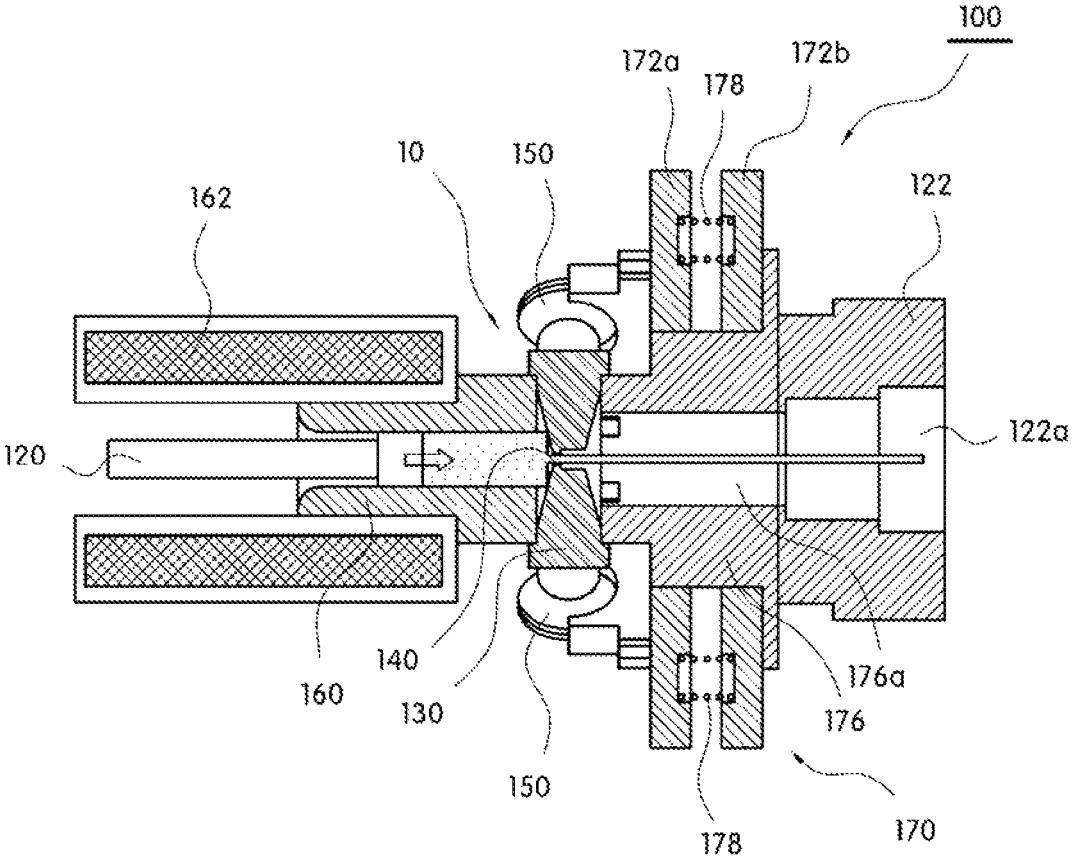
FIG. 5 is a sectional view illustrating an ultrasonic extrusion apparatus for metal material according to the present invention.

An ultrasonic extrusion apparatus 100 for metal material according to the present invention is used in an ultrasonic resonance system which shapes metal extrusion material while resonance of the extrusion die 110 is caused by ultrasonic vibrations. As shown in FIG. 5, the ultrasonic extrusion apparatus 100 includes a die body 130 which is disposed between an extrusion piston 120 and a die holder 122.

The die body 130 forms a main body of the extrusion die 110. Front and rear conical surfaces 132 and 134 which are concave are respectively formed in front and rear surfaces of the die body 130.

Figure 6A:
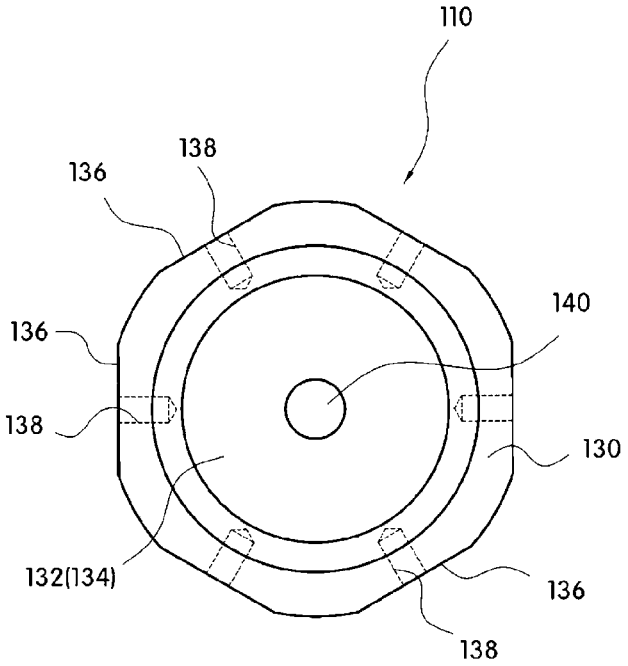
FIG. 6A is a front view illustrating an extrusion die provided in the ultrasonic extrusion apparatus according to the present invention.
Figure 6B:
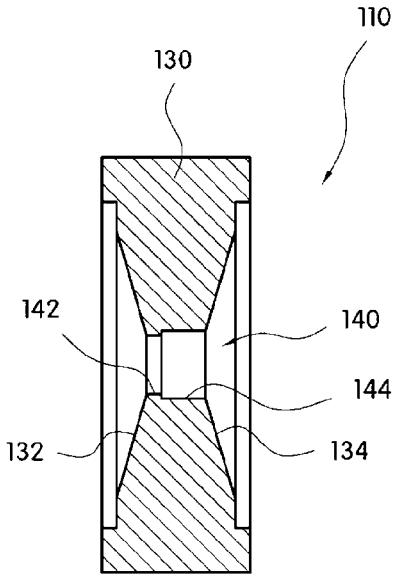
FIG. 6B is a sectional view of the extrusion die of FIG. 6A.

In detail, as shown in FIGS. 6A and 6B, the die body 130 has a disk structure. The front and rear conical surfaces 132 and 134 are respectively formed in the front and rear surfaces of the die body 130 in the opposite directions. An extrusion hole 140 is formed in the die body 130 such that it passes through the centers of the front and rear conical surfaces 132 and 134.

Figure 1A:
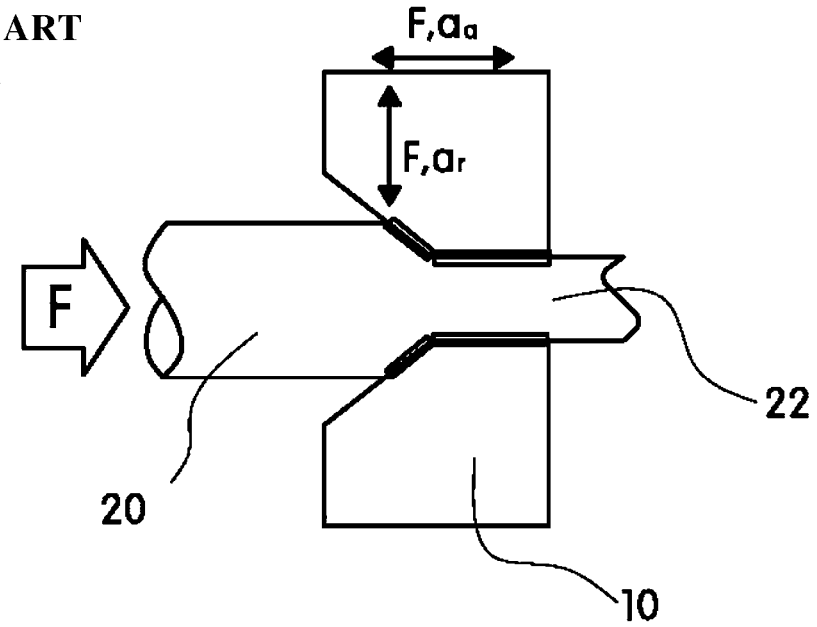
PRIOR ART FIG.1A
FIG. 1A is a sectional view showing a conventional typical extrusion method.
Figure 1B:
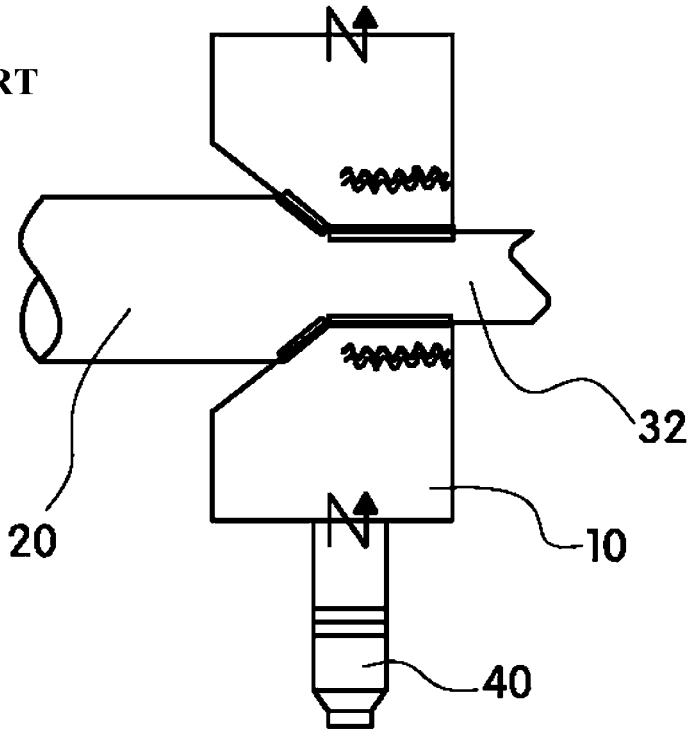
PRIOR ART FIG.1B
FIG. 1B is a sectional view shoeing a conventional extrusion method using an ultrasonic vibrator for applying vibrations to a target.
Figure 2:
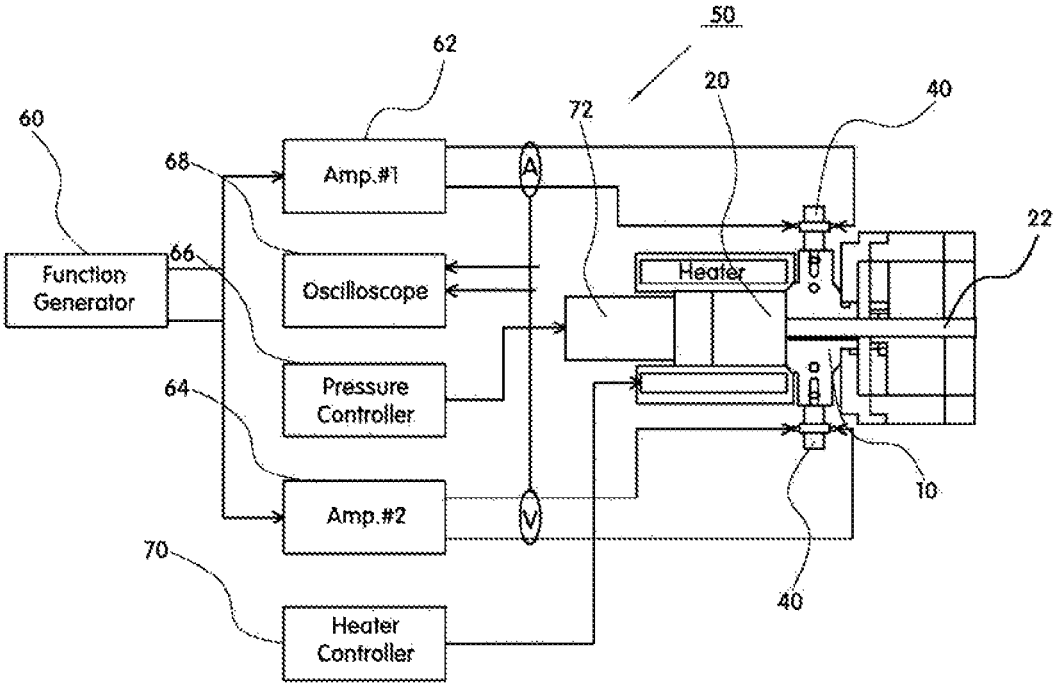
Prior Art FIG.2
FIG. 2 is a vice showing the general construction of a typical ultrasonic resonance system.
Figure 3:
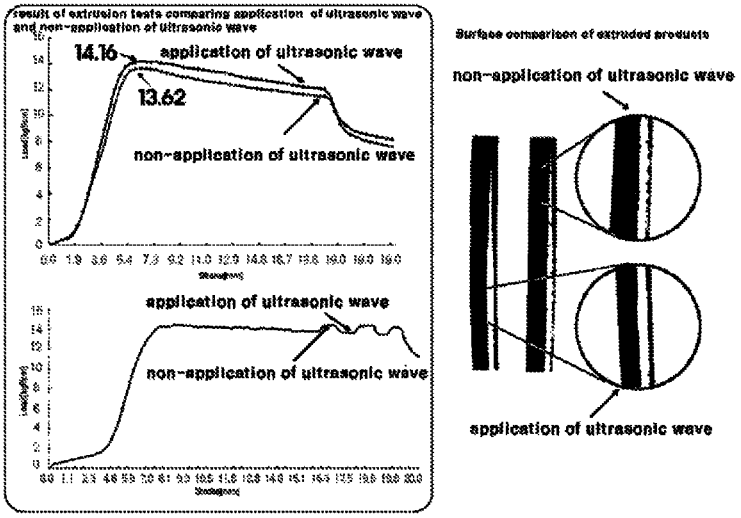
Prior Art FIG.3
FIG. 3 is of graphs comparing the conventional typical extrusion method and the conventional extrusion method using the ultrasonic vibrator.
Figure 4:
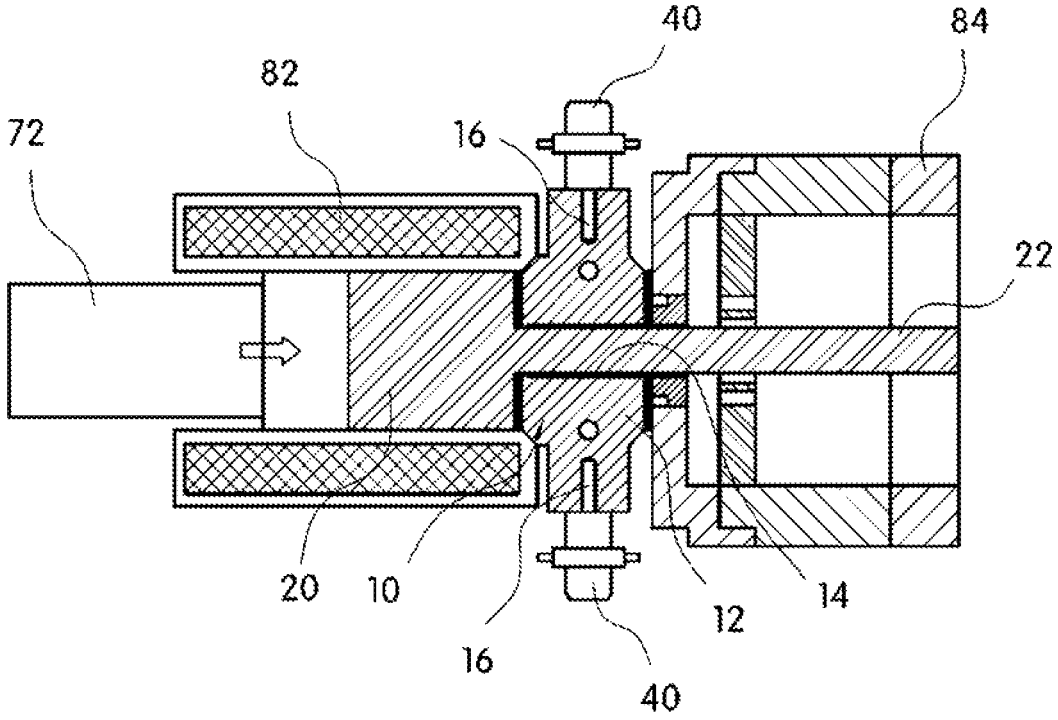
Prior Art FIG.4
FIG. 4 is a sectional view shooing a conventional ultrasonic extrusion apparatus.

The extrusion hole 140 is defined both by a first inner diameter part 142 which actually extrudes material, and by a second inner diameter part 144 which has a diameter larger than that of the first inner diameter part 142 so that the extrusion material that has passed through the first inner diameter part 142 does not make contact with the second inner diameter part 144. It can be understood that the extrusion hole 140 is reduced in size compared to the conventional structure shown in FIG. 4.

Furthermore, the ultrasonic extrusion apparatus 100 according to the present invention includes a plurality of ultrasonic vibrators 150 which are provided on a circumferential outer surface of the die body 130 to apply ultrasonic vibrations to the die body 130.

The ultrasonic vibrators 150 are respectively fastened into mounting holes 130 which are formed in the circumferential outer surface of the die body 130 at positions spaced apart from each other at regular intervals with respect to the circumferential direction. In an embodiment, preferably, six mounting holes 138 are forced at regular circumferential intervals, and six ultrasonic vibrators 150 are fastened into the respective mounting holes 138 so that ultrasonic vibrations are applied to the die body 130.

To install the ultrasonic vibrators 150 on the die body 130, the circumferential outer surface of the die body 130 is diametrically symmetrical based on the extrusion hole 140. In addition, chamfering surfaces 136 are formed on the circumferential outer surface of the die body 130 and spaced apart from each other at regular intervals in the circumferential direction.

The mounting holes 138 are respectively formed in central portions of the chamfering surfaces 136. The ultrasonic vibrators 150 are mounted to the respective chamfering surfaces 136 by the corresponding mounting holes 138.

Figure 7:
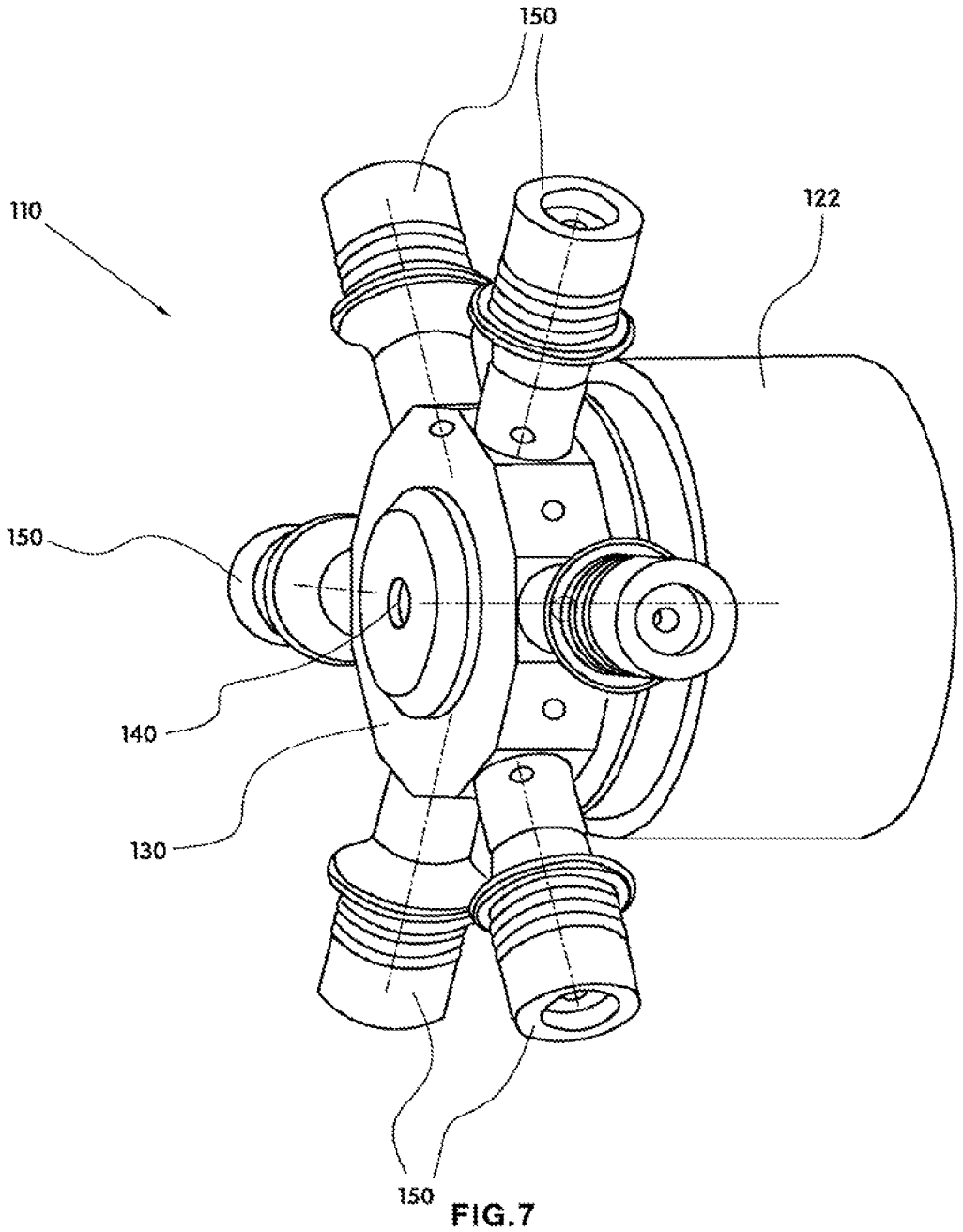
FIG. 7 is a perspective view shooing the structure of the ultrasonic extrusion apparatus to which a plurality of ultrasonic vibrators are mounted in radial directions according to the present invention.

The mounting structure or the ultrasonic vibrators 150 is illustrated in detail in FIG. 7.

As such, in the ultrasonic extrusion apparatus 100 for metal material according to the present invention, the sin ultrasonic vibrators 150 are arranged around the circumferential outer surface of the die body 130 of the extrusion die 110, whereby vibrations can be uniformly applied to the overall portion of the extrusion die 110.

The ultrasonic extrusion apparatus 100 according to the present invention further includes a cylindrical jig 160 which is disposed on the front conical surface 132 of the die body 130.

As shown in FIG. 5, the jig 160 has a cylindrical structure. A rear surface of the jig 100 is brought into line contact with the front conical surface 132 of the die body 130. As such, unlike the conventional technique of FIG. 4 in which the overall front surface of the die body 130 is brought into direct surface contact with extrusion material, the present invention can markedly reduce the contact area between the die body 130 and extrusion material.

Furthermore, an extrusion piston 120 is disposed in the jig 160. A heater 162 is provided around a circumferential outer surface of the jib 160.

When the extrusion operation is conducted, the extrusion piston 120 is operated in the jig 160 that has the cylindrical structure, so that shaping pressure is formed in the jib 160, and extrusion pressure transmitted to the front conical surface 132 of the die body 130 can be markedly reduced.

The ultrasonic extrusion apparatus 100 according to the present invention further includes a vibration isolation unit 170 which is disposed between the rear conical surface 134 of the die body 130 and the die holder 122.

The vibration isolation unit 170 includes front and rear circular plates 172*a* and 172*b* which face each other, a connector 176 which is disposed inside the front and rear circular plates 172*a* and 172*b*, and a plurality of springs 178 which are provided between the front and rear circular plates 172*a* and 172*b*.

Front surfaces of the front circular plate 172*a* and connector 176 of the vibration isolation unit 170 are closely fixed to a rear surface of the die body 130. Rear surfaces of the rear circular plate 172*b* and connector 176 are closely fixed to a front surface of the die holder 122.

Furthermore, a through hole 176*a* is formed in a central portion of the connector 176 so that the extrusion hole 140 communicates with the internal space 122*a* of the die holder 122 through the through hole 176*a*. The diameter of the through hole 176*a* of the connector 176 is larger than that of the extrusion hole 140 of the die body 130.

The vibration isolation unit 170 having the above-mentioned construction functions to reduce vibrations transmitted from the die body 130 to the die holder 122.

In the ultrasonic extrusion apparatus 100 according to the present invention, when the structure thereof is designed, the optimal vibration mode can be determined in such a way that simulations are conducted in consideration of a variety of factors.

Figure 8A:
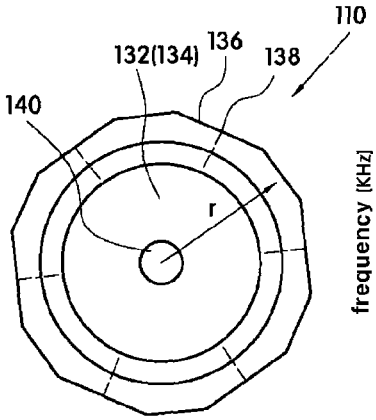
FIGS. 8A and 8B are views illustrating the result of observation of variation in displacement of a vibration mode depending on variation in the radius of the extrusion die of the ultrasonic extrusion apparatus according to the present invention.
Figure 8B:
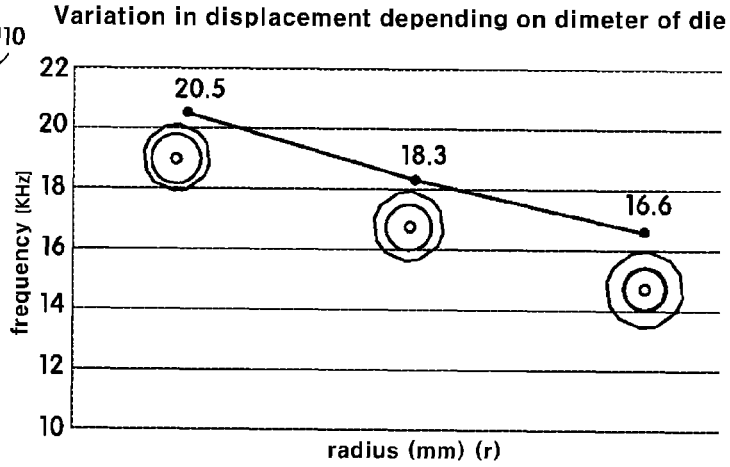

In detail, as shown in FIGS. 8A and 8B, variation in displacement of the vibration mode depending on variation in the radius r of the extrusion die 110 was observed. A target value of displacement (hereinafter, referred to as a frequency) of the vibration mode is 20.5 kHz.

As shown in the graph of FIG. 8B, when the radius r of the extrusion die 110 is 70 mm and the height thereof is 50 mm, the desired displacement could be obtained. However, when the radius r increased to 80 mm or 90 mm, the vibration frequency reduced to 18.3 kHz or 16.6 kHz so that the vibration mode departed from the target value. Therefore, it could be appreciated that variation of the vibration mode depends on the radius r of the extrusion die 110.

Figure 9A:
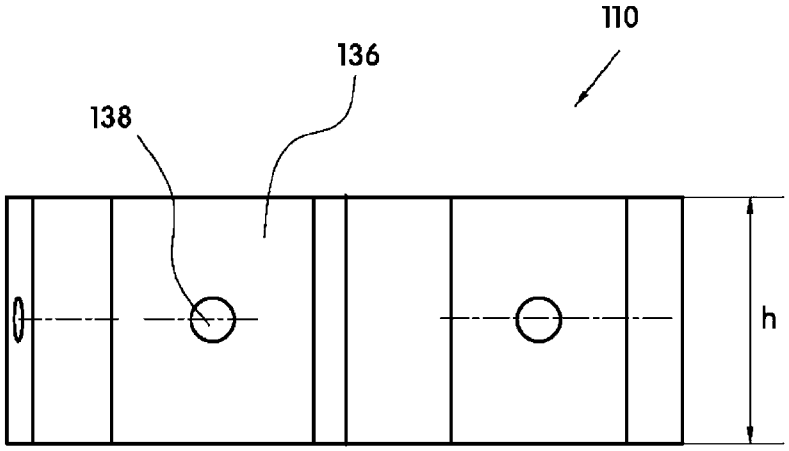
FIGS. 9A and 9B are views illustrating the result of observation of variation in the vibration mode depending on variation in the height of the extrusion die of the ultrasonic extrusion apparatus according to the present invention.
Figure 9B:
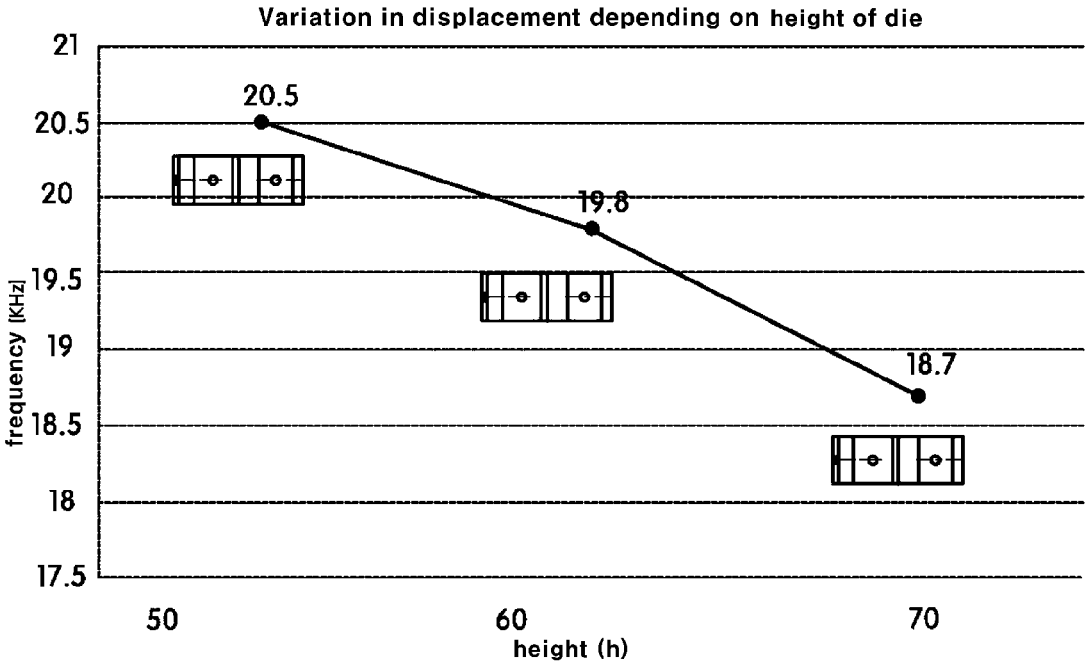

Meanwhile, as shown in FIGS. 9A and 9B, with regard to the ultrasonic extrusion apparatus 100 according to the present invention, it was observed that variation in the vibration mode is affected by variation in the height h of the extrusion die 110.

A target value of the vibration mode is the same 20.5 kHz. The simulation analysis was carried out to observe the variation in the vibration mode as the height h is increased to 50 mm, 60 mm and 70 mm.

When the height h of the extrusion die 110 was 50 mm, the value of the vibration mode was 20.5 kHz, which is the target value, but at 60 mm it was 19.8 kHz, and at 70 mm it was 18.7 kHz.

Furthermore, when the height h increased to 60 mm, the vibration mode was varied in such a way that the extrusion die shrunk inwards. When the height h was 70 mm, the vibration mode was varied in such a way that the extrusion die turned inside out.

Figure 10A:
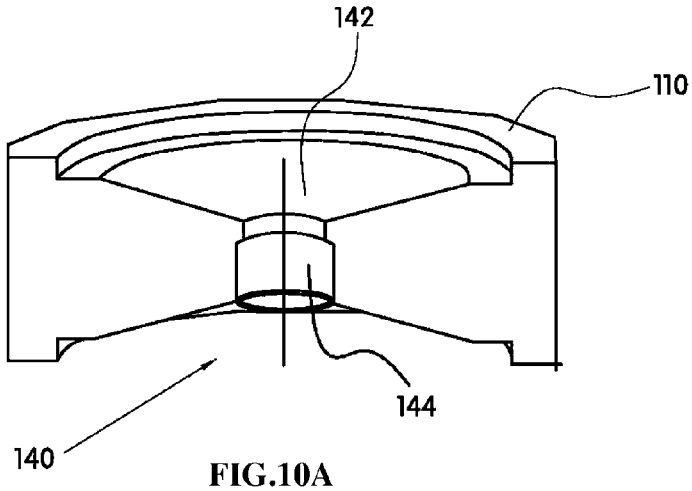
FIGS. 10A and 10B are views or illustrating the result of observation of variation in the vibration mode depending on variation in the size of an extrusion hole of the extrusion die of the ultrasonic extrusion apparatus according to the present invention.
Figure 10B:
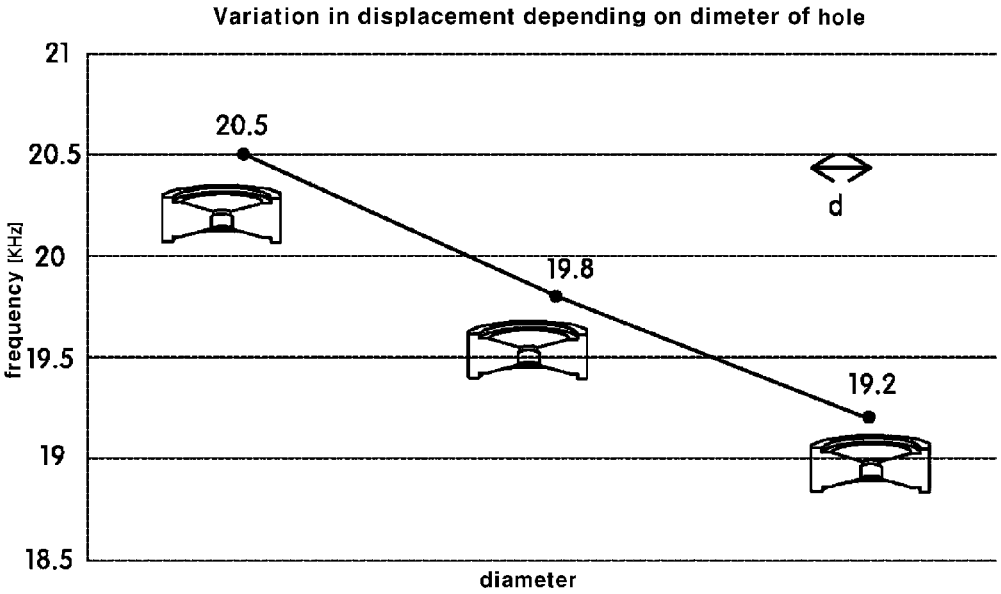

As shown in FIGS. 10A and 10B, with regard to the ultrasonic extrusion apparatus 100 according to the present invention, variation in the vibration mode depending on variation in the size of the extrusion hole 140 of the extrusion die 110 was observed. The extrusion die 110 of FIG. 10A has a double-stepped hole structure which includes the first inner diameter part 142 which has a radius of 10 mm and a height of 5 mm, and a second inner diameter part 144 which has a radius of 11.5 mm and a height of 15 mm.

Here, a first-step hole of the first inner diameter part 142 that has a radius of 10 mm is fixed in size for extrusion. In this experiment, the simulation analysis was performed to observe variation in the vibration mode as the size of the hole of the second inner diameter part 144 varies.

According to the result of the simulations performed while the radius of the second inner diameter part 144 varies to 11.5 mm, 15.5 mm and 19.5 mm, the frequency of the vibration mode varied to 20.5 kHz, 19.8 kHz and 19.2 kHz. It can be understood that, compared to variation in the size of the hole, the variation in the vibration mode is less.

Figure 11A:
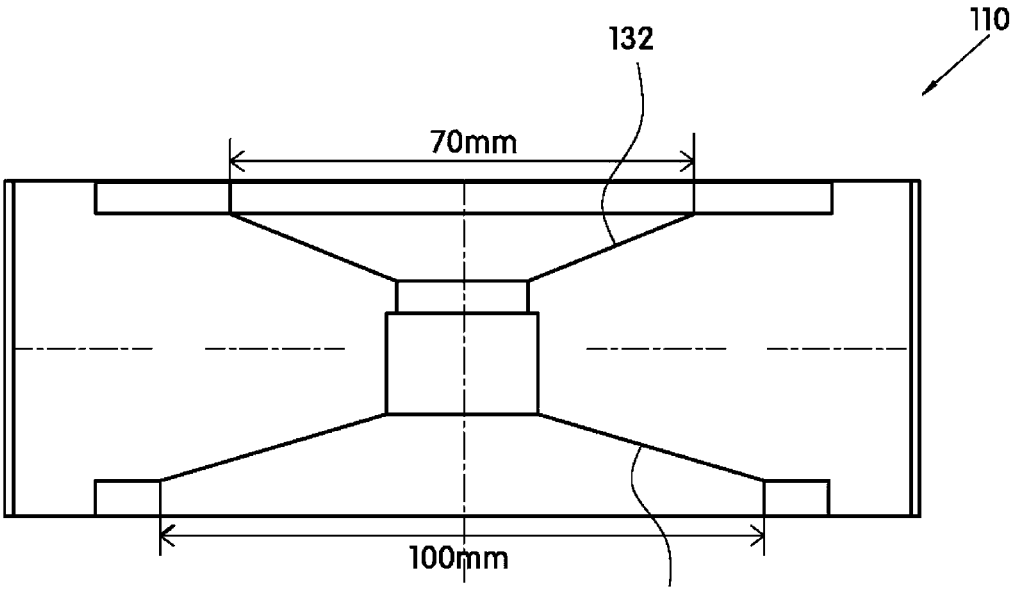
FIGS. 11A and 11B are views illustrating the result of observation of variation in the vibration mode depending on variation in the size of a conical surface of the extrusion die of the ultrasonic extrusion apparatus according to the present invention.
Figure 11B:
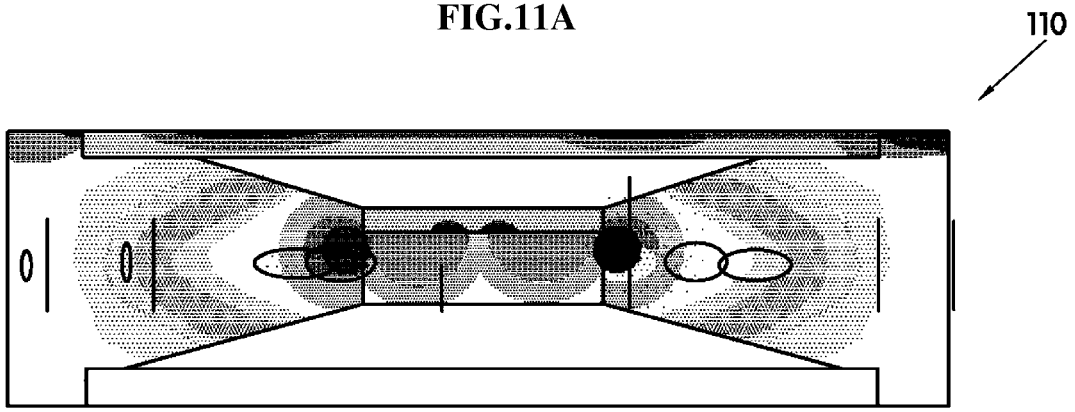

Furthermore, as shown in FIGS. 11A and 11B, with regard to the ultrasonic extrusion apparatus 100 according to the present invention, a simulation was conducted when the front and rear conical surfaces 132 and 134 based on the extrusion hole 140 of the extrusion die 110 are different from each other, being respectively 70 mm and 100 mm.

Although it was expected that variation in the vibration mode would be comparatively large depending on the size of the front or rear conical surface 132 or 134, it was 20.7 kHz, that is, it was cot largely changed. Therefore, it was confirmed that the size of the front or rear conical surface 132 or 134 did not largely affect variation in the vibration mode.

As such, according to the result of simulations for the ultrasonic extrusion apparatus 100 of the present invention that were carried out in consideration of different kinds of factors, the vibration mode varied most significantly in accordance with the radius r of the extrusion die 110, and, to a lesser extent, in accordance with the height h of the extrusion die 110. It could be under stood that the radius of the extrusion hole 140 can be used to finely control the vibration mode.

As shown in FIGS. 12A and 12B, a simulation of a series of vibration transmission with regard to the convention extrusion die 10 was carried out, and the result of the simulation was analyzed.

As can be understood from the result of the analysis, although vibrations are biased towards the center of the extrusion die 10, they are concentrated on opposite corners and a lower portion of the extrusion die 10. This means that vibrations generated by the ultrasonic vibrators 40 spread downward and sideways so that the vibrations are not reliably transmitted towards the center of the extrusion die 10.

Furthermore, in the conventional extrusion die 10, when vibrations are applied thereto, they must be concentrated on small holes formed on an upper end of the extrusion die 10 so as to reduce friction, thus reducing pressure by which an extrusion material must be pushed forwards. However, vibrations are concentrated just on the center of the extrusion die 10. Thus, when an actual extrusion process is conducted, the effect of the ultrasonic vibrators is reduced.

However, as shown in FIGS. 13A and 13B, according to the result of the analysis of the ultrasonic extrusion apparatus 100 of the present invention, it was found that vibrations are concentrated on the center of the extrusion die 110 and transmitted to the first inner diameter part 142 that defines the actual extrusion size of the extrusion hole 140. It was analyzed that this result is possible because the present invention is configured such that the upper and lower portions of the extrusion die 110 are in balance, and vibrations can be concentrated on the center of the extrusion die 110 through the front and rear conical surfaces 132 and 134.

Therefore, according to the result of the analysis of the ultrasonic extrusion apparatus 100 of the present invention, it is most important that the extrusion die 110 is designed such that the shape thereof is as balanced as possible. Furthermore, the size of the extrusion die 110 must be determined depending on the size of the extrusion die 110 and the number of vibrators.

In the ultrasonic extrusion apparatus 100 of the present invention having the above-mentioned construction, the front and rear conical surfaces 132 and 134 that are concave are respectively formed on the front and rear surfaces of the die body 130 which is disposed between the extrusion piston 120 and the die holder 122. In addition, the cylindrical jig 160 is provided on the front conical surface 132. Thereby, the extrusion pressure which is transmitted to the front surface of the die body 130 can be markedly reduced.

Furthermore, in the present invention, the vibration isolation unit 170 is installed between the rear conical surface 134 of the die body 130 and the die holder 122 so that vibrations which are transmitted from the die body 130 to the die holder 122 can be markedly reduced. Moreover, the six ultrasonic vibrators 150 which apply vibrations to the extrusion die 110 are arranged around the extrusion die 110 in the circumferential direction so that vibrations can be evenly applied to the entirety of extrusion die 110.

Therefore, vibrations which are generated from the ultrasonic vibrators 150 mounted to the extrusion die 110 can be effectively transmitted to the extrusion die 110. Thereby, when the extrusion process is conducted, friction between the extrusion die 110 and extrusion material can be minimized. As a result, compared to the conventional ultrasonic extrusion apparatus, high-density and high-quality metal products can be manufactured at a high production rate.

Although the preferred embodiment of the present invention has been disclosed for illustrative purposes, the present invention is not limited to such a special structure. Those skilled in the art will appreciate that various modifications, additions and substitutions are possible, without departing from the scope and spirit of the invention as disclosed in the accompanying claims. For example, although the number of chamfering surfaces 136 formed on the circumferential outer surface of the die body 130 has been illustrated as being six so that the six ultrasonic vibrators 150 are mounted to the respective chamfering surfaces 136 through the six corresponding mounting holes 138, the number of chamfering surfaces 136 or ultrasonic vibrators 150 may be changed, e.g., within a range from four to twelve. It should be understood that such simple design modifications or changes fall within the bounds of the present invention.

What is claimed is:

1. An ultrasonic extrusion apparatus for extruding a metal material in such a way that an extrusion die is resonated by ultrasonic vibrations, the ultrasonic extrusion apparatus comprising:

a die body disposed between an extrusion piston and a die holder;

front and rear conical surfaces respectively formed on front and rear surfaces of the die body, each of the front and rear conical surfaces being concave;

an extrusion hole passing through central portions of the front and rear conical surfaces between the front and rear conical surfaces, the extrusion hole being defined by: a first inner diameter part through which the metal material is actually extruded; and a second inner diameter part having a diameter larger than the first inner diameter part so that the metal material that has passed through the first inner diameter part is prevented from coming into contact with the second inner diameter part; and a plurality of ultrasonic vibrators mounted to a circumferential outer surface of the die body, the ultrasonic vibrators applying the ultrasonic vibrations to the die body, wherein the ultrasonic vibrators are arranged around the circumferential outer surface of the extrusion hole of the die body to be symmetrical based on the extrusion hole so that the ultrasonic vibrations are evenly applied to the die body, wherein a plurality of chamfering surfaces are formed on the circumferential outer surface of the extrusion hole of the die body at positions spaced apart from each other at regular intervals with respect to a circumferential direction, a mounting hole is formed in a central portion of each of the chamfering surfaces, and the ultrasonic vibrators are mounted to the respective chamfering surfaces through the corresponding mounting holes.

2. The ultrasonic extrusion apparatus as set forth in claim 1, wherein the chamfering surfaces comprise six chamfering surfaces formed on the circumferential outer surface of the die body, and the ultrasonic vibrators comprise six ultrasonic vibrators mounted to the respective six chamfering surfaces through the corresponding six mounting holes.

3. The ultrasonic extrusion apparatus as set forth in claim 1, further comprising a cylindrical jig disposed on the front conical surface of the die body, wherein the extrusion piston is disposed in the jig so that a shaping pressure is formed in the jig, thus reducing an extruding pressure applied to the front conical surface of the die body.

4. The ultrasonic extrusion apparatus as set forth in claim 1, further comprising a vibration isolation unit disposed between the rear conical surface of the die body and the die holder to reduce a vibration transmitted from the die body to the die holder, the vibration isolation unit comprising: front and rear circular plates disposed facing each other; and a connector disposed inside the front and rear circular plates, wherein front surfaces of the front circular plate and connector are closely fixed to a rear surface of the die body, and rear surfaces of the rear circular plate and connector are closely fixed to a front surface of the die holder, and a through hole is formed in a central portion of the connector so that the extrusion hole communicates with an internal space of the die holder through the through hole.

5. The ultrasonic extrusion apparatus as set forth in claim 4, wherein the through hole of the connector has a diameter larger than the diameter of the extrusion hole of the die body.

* * * * *

UNITED STATES PATENT AND TRADEMARK OFFICE

CERTIFICATE OF CORRECTION

PATENT NO. : 9,156,072 B2
APPLICATION NO. : 13/731468
DATED : October 13, 2015
INVENTOR(S) : Hyun Rok Cha et al.

It is certified that error appears in the above-identified patent and that said Letters Patent is hereby corrected as shown below:

In the Specification

Column 1, line 35, “10” to read as --40--.

Column 1, line 40, “shoos” to read as --shows--.

Column 1, line 47, “too” to read as --the--.

Column 1, line 53, “at” to read as --of--.

Column 1, line 53, “from” to read as --form--.

Column 2, line 8, “34” to read as --84--.

Column 2, line 9, “hole” to read as --hole 14--.

Column 2, line 11, “10” to read as --10.--.

Column 2, line 16, “amounting” to read as --mounting--.

Column 2, line 16, “end” to read as --and--.

Column 3, line 64, “foe” to read as --be--.

Column 3, line 67, “our face” to read as --surface--.

Column 4, line 25, “shoeing” to read as --sectional--.

Column 4, line 28, “vice” to read as --view--.

Column 4, line 33, “shooing” to read as --showing--.

Column 4, line 42, “shooing” to read as --showing--.

Column 4, line 55, “or illustrating” to read as --illustrating--.

Column 5, line 49, “130” to read as --138--.

Column 6, line 4, “sin” to read as --six--.

Column 6, line 14, “100” to read as --160--.

Column 7, line 51, “cot” to read as --not--.

Column 7, line 60, “under stood” to read as --understood--.

Signed and Sealed this
Twenty-ninth Day of March, 2016

Michelle K. Lee

Michelle K. Lee
*Director of the United States Patent and Trademark Office*